US006896403B1

(12) United States Patent
Grau

(10) Patent No.: US 6,896,403 B1
(45) Date of Patent: May 24, 2005

(54) MODE SELECTING ASSEMBLY FOR A TIMEPIECE

(75) Inventor: Siegfried Grau, Pforzheim (DE)

(73) Assignee: Timex Group B.V. (NL)

( * ) Notice: Subject to any disclaimer, the term of this patent is extended or adjusted under 35 U.S.C. 154(b) by 83 days.

(21) Appl. No.: 10/331,827

(22) Filed: Dec. 30, 2002

(51) Int. Cl.[7] ..... G04B 27/02
(52) U.S. Cl. ..... 368/190; 368/319; 368/321
(58) Field of Search ..... 368/184, 185, 368/206, 216, 187, 190, 319, 320, 321, 69

(56) References Cited

U.S. PATENT DOCUMENTS 3,151,441 A * 10/1964 Tsuzuki ..... 368/185
3,668,864 A * 6/1972 Miyasaka ..... 368/31
3,707,840 A * 1/1973 Miyasaka ..... 368/320
4,034,553 A * 7/1977 Wuthrich ..... 368/320
4,104,866 A * 8/1978 Chappatte ..... 368/319
4,126,992 A * 11/1978 Yasuda ..... 368/216
4,228,647 A * 10/1980 Yajima ..... 368/185
6,203,190 B1 * 3/2001 Stotz ..... 368/320
6,422,740 B1 * 7/2002 Leuenberger ..... 368/320

* cited by examiner

*Primary Examiner*—Tulsidas Patel
*Assistant Examiner*—Jeanne-Marguerite Goodwin
(74) *Attorney, Agent, or Firm*—Carmody & Torrance LLP

(57) ABSTRACT

The mode selecting assembly comprises a flexible hand, coupled to a frame in the casing, that has extending therefrom fingers that are sufficiently deflectable so as to deflect from first positions where they are not in contact with associated pads on a circuit board to second positions where they are in contact with their associated pads on the circuit board. A setting stem comprises an annular ring for selectively contacting and deflecting the fingers from their respective first positions to second positions, wherein the integrated circuit is operable in a selected modes depending on which finger is in the second position.

6 Claims, 6 Drawing Sheets

MODE SELECTING ASSEMBLY FOR A TIMEPIECE

BACKGROUND OF THE INVENTION

This invention relates generally to timepieces and more particularly, to an improved assembly to provide mode selectability through the use of an axially displaceable setting stem.

For many years, watch designers have utilized the axial settings of the setting stem to carry out a wide range of functions. For example, the axial displacement of the setting stem has been used to mechanically engage one or more setting gears, such as those to set the hour and minute hands and/or the date wheel, for normal time/date setting.

More recently, Timex Corporation, an innovator in watch technology, improved the state of the art in its patented use of a setting stem to adjust time displayed in a digital watch. An exemplary embodiment is described and claimed in U.S. Pat. No. 6,203,190, the disclosure of which is incorporated by reference as if fully set forth herein.

Specifically, U.S. Pat. No. 6,203,190 describes the use of a printed circuit board on which there are a plurality of contact terminals. A rotating function lever contacts the respective contact terminals depending on the axial position of the settings stem based on the physical engagement therebetween. Depending on which contact terminal is being contacted, the integrated circuit will operate in one of several modes.

In yet another example, an axial displaceable setting stem can be used in a chronograph watch to vary the operating modes. An exemplary embodiment is described in U.S. Pat. No. 5,473,580, the disclosure of which is also incorporated by reference as if fully set forth herein.

For example, the '580 patent describes that in placing the setting stem in a first drawn-out position, the watch enters an initialization mode, wherein upon the selective depression of certain pushers the smaller "chronograph" hands reset themselves to all initial starting position. In placing the setting stem in a second drawn-out position, the pressing on a selected pusher causes the large chronograph hand to reset to zero. Pressing the selected pushers while the setting stem is in normal (non-drawn-out) position will cause the chronograph function to begin timing.

It can thus be seen that it is known in the art that the setting stem's axial position can be utilized for putting the timepiece in a plurality of different operating modes, whether in a digital watch, a chronograph watch, or any combination thereof.

However, it is believed that the construction and arrangement of the mechanical and electrical elements to carry out this mode selectability can be further advanced. For example, one perceived disadvantage of the prior art is the underutilization of space within the watch's casing.

Therefore, a mode selecting assembly that overcomes certain perceived disadvantages and achieves the advantages set forth below is desired and is provided by the present invention.

SUMMARY OF THE PRESENT INVENTION

Therefore, it is an object and advantage of this invention to provide an improved mode selecting assembly for use in a timepiece, such as in a digital watch, chronograph watch, or some combination thereof.

It is also an object of the present invention to provide a mode selecting assembly that utilizes a minimum amount of space in the watch's casing.

It is another object and advantage of this invention to simplify the manufacture of such watches.

Still other objects and advantages of the invention will in part be obvious and will in part be apparent from the specification.

The invention accordingly comprises the features of construction, combination of elements and arrangement of parts which will be exemplified in the construction hereinafter set forth, and the scope of the invention will be indicated in the claims.

Therefore, in accordance with the present invention, a mode selecting assembly for a timepiece is provided. Novel to this assembly is the use of a flexible hand having extending therefrom a plurality of fingers that are sufficiently deflectable so as to deflect from respective first positions where they are not in contact with an associated contact pad on a circuit board to second positions where they are in contact with their associated pads on the circuit board. In connection therewith is a setting stem mounted in and extending out of an opening in the casing, the setting stem being positionable in at least two axial positions, the setting stem comprising an annular ring for selectively contacting and deflecting the fingers from their respective first positions to second positions; wherein an integrated circuit is responsive to the positioning of the fingers to operate in respectively different modes.

BRIEF DESCRIPTION OF THE DRAWINGS

The above set forth and other features of the invention are made more apparent in the ensuing Detailed Description of the Preferred Embodiments when read in conjunction with the attached Drawings, wherein.

Identically labeled elements appearing in different ones of the above described figures refer to the same elements but may not be referenced in the description for all figures.

DETAILED DESCRIPTION OF THE PREFERRED EMBODIMENTS

Figure 1:
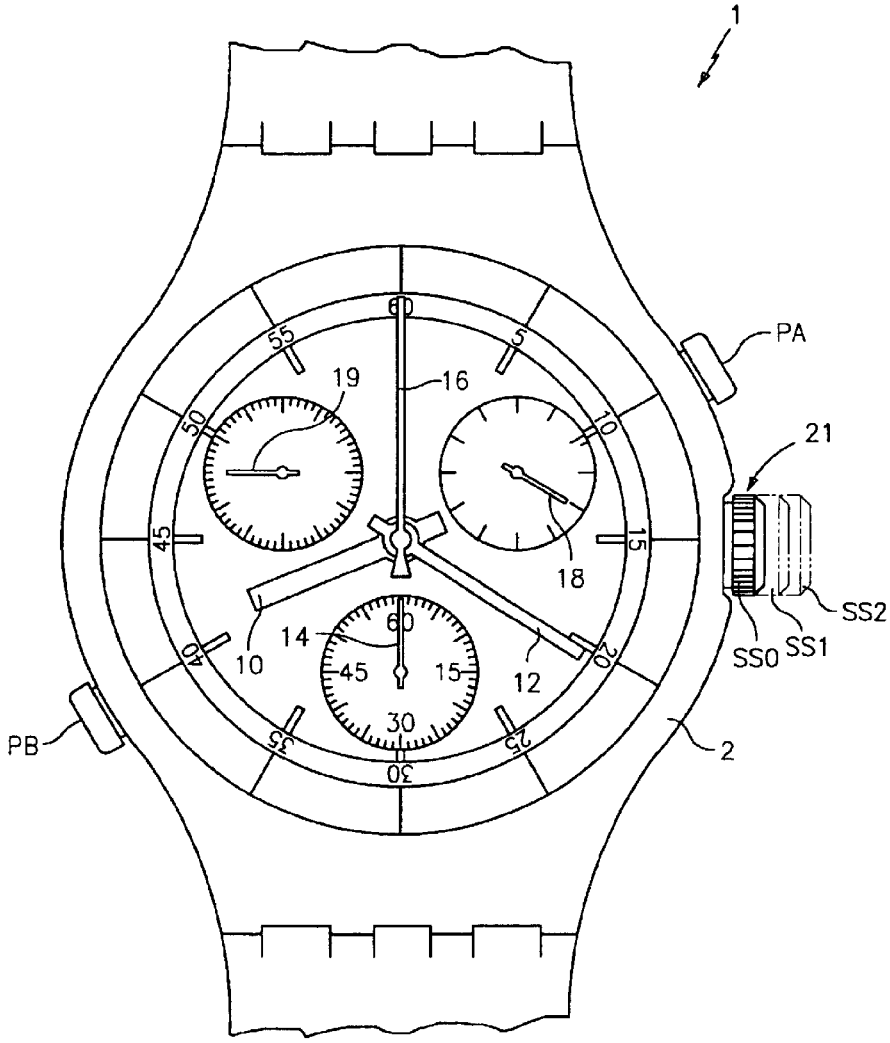
FIG. 1 is a plan view of a conventional chronograph watch that incorporates the mode selecting assembly constructed in accordance with the present invention.

Reference is first made to FIG. 1 for a basic disclosure on the operation and functionality of a generic chronograph watch, one of the preferred types of watches in which the present invention is incorporated. However, the fact that the present invention is first disclosed in connection with a chronograph watch should not be viewed in a limiting sense, since, as it will be disclosed below, the present invention is applicable in a wider range of products, including a wide range of watch types.

Figure 2:
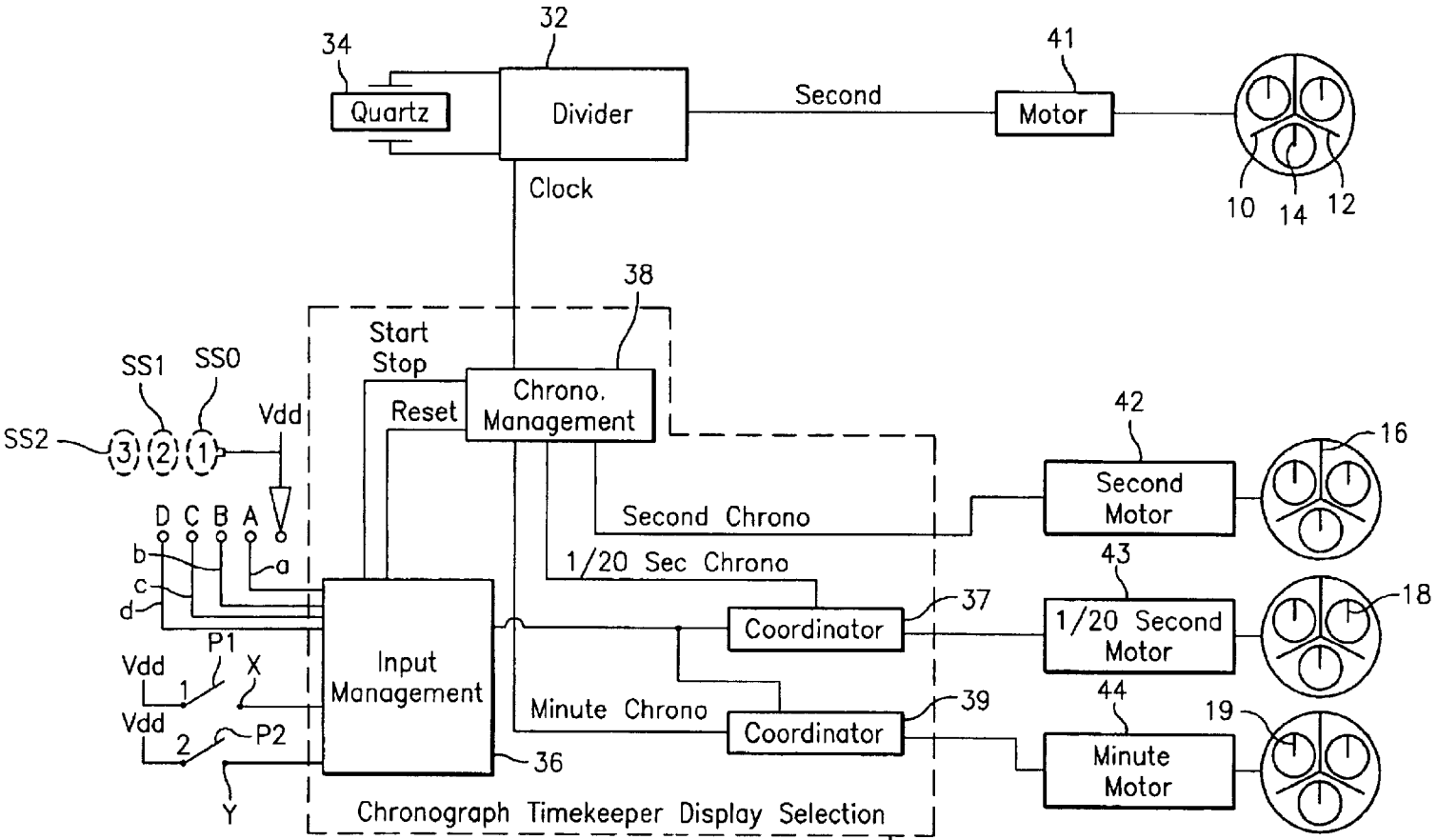
FIG. 2 is a schematic diagram illustrating an exemplary electronic circuit of a chronograph watch that utilizes the present invention.

As the general aspects of a chronograph watch are well known, only all overviews thereof is provided. For example, FIG. 1 illustrates a typical chronograph watch, generally indicated at 1, and includes timekeeping hands 10, 12 for displaying the time of day. A small seconds hand 14 is provided at the 6:00 position for the seconds. Such hands may be coupled together by a mechanical dial train, with hand 14 generally being driven directly by the rotor spindle of a first stepping motor, all of which is well known in the art. Chronograph watch 1 also includes three other chronograph indicators in order to display a time interval; namely a hand 16 in order to count seconds, a small hand 18 in order to count in intervals in 1/20 seconds, and another small hand 19 for counting minutes. Typically, as would be known, a second stepping motor may be used to drive hand 16, a third stepping motor for driving hand 18 and a yet a fourth stepping motor for driving hand 19, all of which are illustrated in FIG. 2.

In the preferred embodiment, manual pushers PA and PB are used to selectively start, stop and reset/calibrate the chronograph hands 16, 18 and 19. By way of general background, small hand 18, which illustrates intervals of 1/20 seconds, rotates over a dial including 20 divisions, while small hand 19, which counts minutes, is displayed oil a dial that preferably includes 30 divisions, it being clear that with each revolution of hand 16, hand 19 advances through one division thus indicating elapsed time in minutes.

The ability of watch 1 to operate in a plurality of modes depending on the axial position of a crown 21 which is coupled to a setting stem, such as that illustrated by reference numeral 20, is not new, and is described, by way of an exemplar configuration and circuitry/logic therefor, in the aforementioned U.S. Pat. No. 5,473,580.

In the present invention however, chronograph hands 16, 18 and 19 may be reset/calibrated (i.e. to zero or another reference) by the coordinated pressing of pushers PA and PB while setting stem 20 (and thus crown 21) has been extended in its various axial directions.

For example, when the setting stem is in its first extended position SS1, depressing pusher PB will allow for the resetting/calibration of hand 19. When the setting stem 20 is in its second pulled position SS2, depression of pusher PA will incrementally reset/calibrate hand 16, while depression of pusher PB will incrementally reset/calibrate hand 18.

When setting stem 20 is in its normal run position (SS0), depression of pusher PA will begin the incremental movement of hand 16 in the "chrono" mode. Pressing pusher PB when the "chrono" mode has been stopped will cause the reinitialization of hands 16, 18 and 19 to their starling positions. As would also be known, when setting stem 20 is brought into its second drawn-out position SS2, it is possible to proceed with manual time setting of the timekeeper hands 10, 12 by rotation of setting stem 20. In this extended setting stem position, small seconds hand 14 is blocked in a known manner, which enables setting hands 10, 12.

Therefore it can be seen as an exemplary embodiment, that when setting stem is in a first (normal) run position SS0, watch 1 is in a normal run mode; when the setting stem is in a first drawn position SS1, watch 1 is in a first reset/calibration mode; and when the setting stem is in a second drawn position SS1, watch 1 is in a second reset/calibration mode. It should be understood that reference to "watch 1 being in a reset/calibration and/or run mode" should be understood to be synonymous to the integrated circuit being in a corresponding mode, as it is the integrated circuit that provides for the control of the watch modes and functionality.

Reference is thus briefly made to FIG. 2, wherein a block schematic diagram exhibiting the electronic portion of chronograph watch 1, is illustrated. Here again, the schematic illustrates exemplary technology well known in the art, and therefore, only general reference shall be made thereto. Other modifications and/or changes may be made while remaining within the scope of the present invention, for reasons that will become apparent below.

FIG. 2 principally illustrates a chronograph/timekeeper display selection block 30 and a frequency divider 32, both of which can form part of an integrated circuit that is available in the existing market. To such an integrated circuit is connected on the one hand, setting stem contacts A, B, C, D and the pusher contacts X, Y and on the other hand the four stepping motors 41 to 44. A quartz timebase 34 is connected to the input of divider 32 of the integrated circuit. Also preferably included is an input manager 36 for receiving the pusher entries and controlling certain functionalities depending on the axial position of the setting stem 20 based on the receipt of the respective signals at contacts A, B, C and D; and a chronograph manager 38, all working together to function as set forth above, and as described in, for example, the aforementioned U.S. Pat. No. 5,473,580. Two coordinators 37 and 39 coordinate the inputs from managers 36 and 38 to the motors 43, 44 all in a way known and/or obvious to one skilled in the art.

Pertinent to the present invention and illustrated is the mode selectivity to the input manager 36 based on the axial position of the setting stem 20, thus being able to provide both the differing mode selection and functionality as set forth above. That is, FIG. 2 illustrates schematically how a VDD signal selectively energizes a respective signal path connected to a respective contact A, B, C, and D. That is in accordance with the present invention, an improved mode selecting assembly has been provided and shall now be disclosed, with reference being specifically made to FIGS. 3–9.

Specifically, in accordance with the present invention, a mode selecting assembly, generally indicated at 100, is provided. Assembly 100 is particularly adaptable for a timepiece, such as watch 1, that itself comprises:

a casing 2;

a frame 3 in casing 2;

an integrated circuit (such as that illustrated in FIG. 2) disposed in the casing and operable in at least 2 modes, such as, but not limited to, the aforementioned "normal" run mode, and one or more resetting/calibration modes; and a circuit board 4 also disposed in casing 2.

Figure 3:
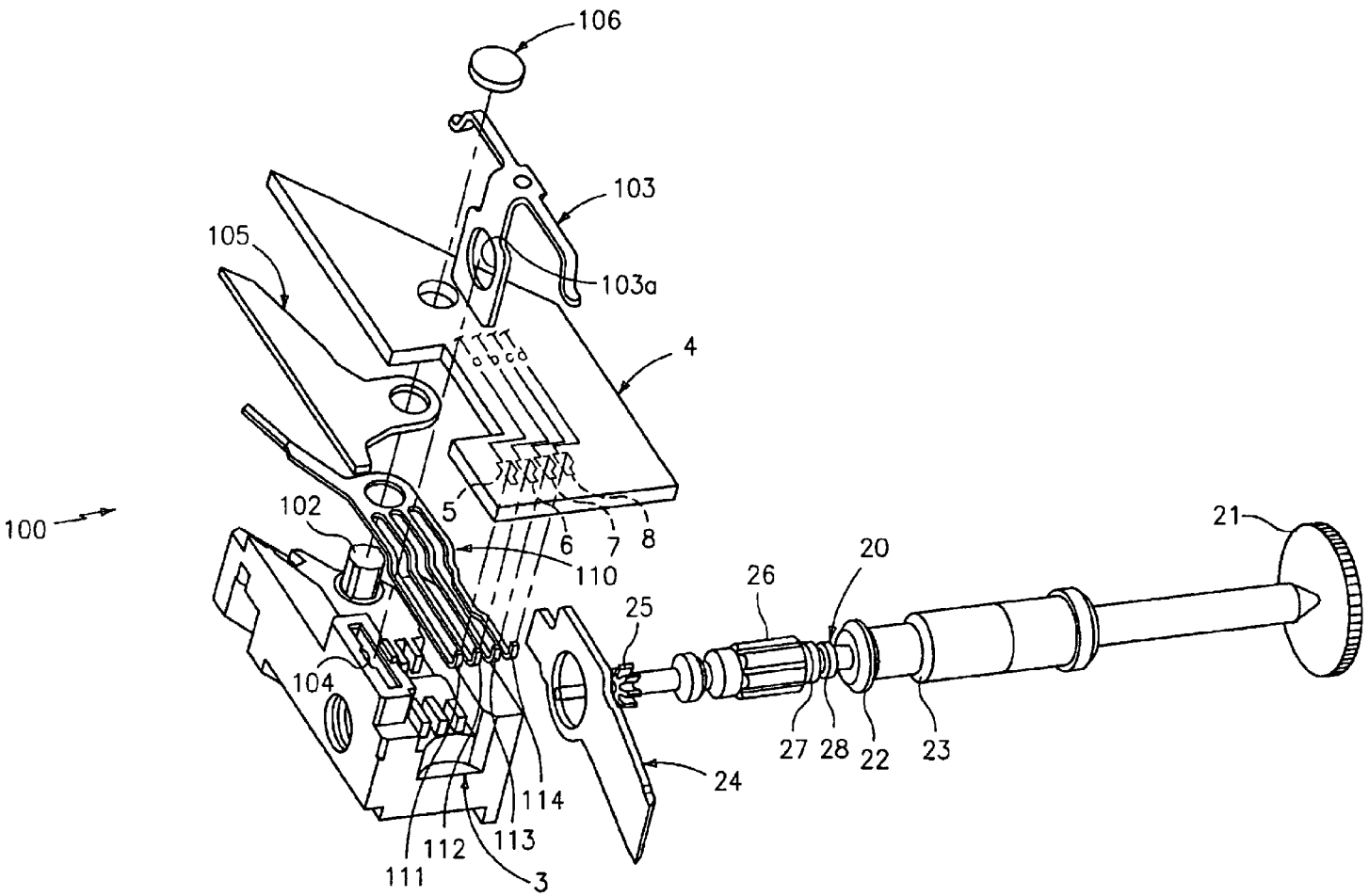
FIG. 3 is an exploded view of a mode selecting assembly constructed in accordance with the present invention.

As illustrated most clearly in FIG. 3, circuit board 4 includes (i) at least two contact pads 5 and 6 (which correspond schematically to contacts A and B in FIG. 2) and (ii) respective signaling paths "a" and "b" from the respective contact pads 5 and 6 to the integrated circuit, and hence to the input manager 36 in particular.

Turning to assembly 100 itself, the Figures clearly illustrate that the connection between VDD and the contacts A (pad 5) and B (pad 6) preferably utilizes a flexible hand, generally indicated at 110, coupled to the frame by being mounted through an aperture onto a pillar 102 thereof.

The mechanical configuration to get the desired voltage signals to flexible hand 110 is certainly one of design choice and clearly within the scope of a skilled artisan. For example, in a preferred embodiment a spring push button 105 is used in part to couple the VDD contact of the battery to the VDD of the PCB.

Flexible hand 110 has extending therefrom:

at least a first finger 111 being sufficiently deflectable so as to deflect from a first position (FIG. 7) where it is not in contact with its associated pad 5 on circuit board 4 to a second position (FIG. 6) where it is in contact with its associated pad 5 on circuit board 4; and a second finger 112 being sufficiently deflectable so as to deflect from a first position (FIG. 6) where it is not in contact with its associated pad 6 on circuit board 4 to a second position (FIG. 7) where it is in contact with its associated pad 6 on circuit board 4.

Figure 4:
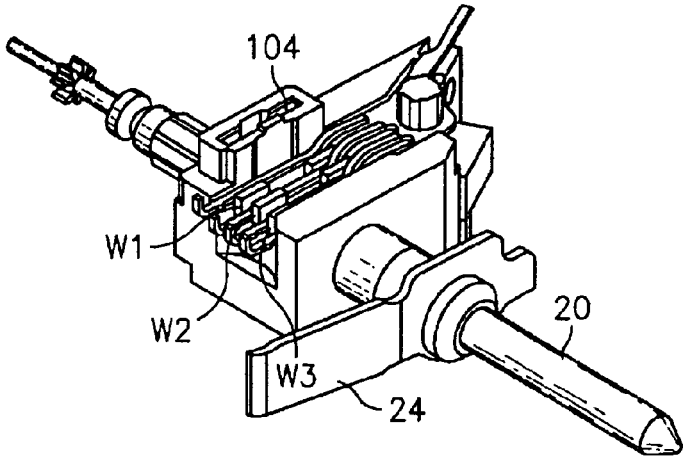
FIG. 4 is a perspective view of the mode selecting assembly of FIG. 3 having been constructed.

It can be seen most clearly from FIG. 4 that each of the fingers sit within respective channels, with walls W1, W2, W3 separating each channel. Each channel is dimensioned to restrict too much horizontal movement of the fingers, because of their fragile construction. Of course, larger fingers could be used but the channels permit hand 110 to be made smaller and lighter. Assembly 100 also includes the aforementioned rotatable setting stem 20 rotatably mounted in frame 3 and extending out of an opening in casing 2, the design and construction all of which is well known in the art.

In accordance with the present invention, rotatable setting stem 20 is positionable in at least two axial positions and preferably four axial positions (compare FIGS. 6–9). To carry out the present intention, setting stem 20 comprises an annular ring 22, most preferably formed by the known processes of screw machining, for selectively contacting and deflecting the at least first and second fingers 111, 112 between their respective first positions and their second positions (see FIGS. 6 and 7).

In this way, in a first axial position (SS0), annular ring 22 contacts and deflects first finger 111 from its first position to its second position and in a second axial position (SS1), annular ring 22 contacts and deflects second finger 112 from its first position to its second position. When first finger 111 is in the second position the integrated circuit is operable in a first mode, such as the "normal" run mode, and when second finger 112 is in the second position the integrated circuit is operable in a second mode, such as a first resetting/calibration mode, as discussed above. Importantly, when first finger 111 is in its second position second finger 112 is in its first position, and when second finger 112 is in its second position first finger 111 is in its first position.

Preferably, flexible hand 110 comprises more than two (2) extending fingers. It should be understood that such additional fingers (i.e. fingers 113 and 114) are constructed and function in a way similar to that set forth above with respect to fingers 111, 112. In such an embodiment, circuit board 4 comprises at least a third contact pad 7 and a fourth contact pad 8 and respective signaling paths "c" and "d" (see FIG. 2) from the third and fourth contact pads 7, 8 to the integrated circuit (i.e. corresponding contacts C, D and signaling paths "c" and "c" all schematically being illustrated in FIG. 2).

Figure 8:
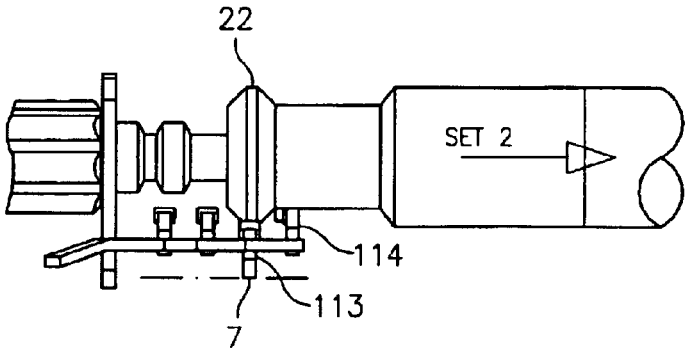
FIG. 8 is a side view of a portion of the mode selecting assembly of FIGS. 3 and 4, and illustrating the setting stem in a second pulled position.
Figure 9:
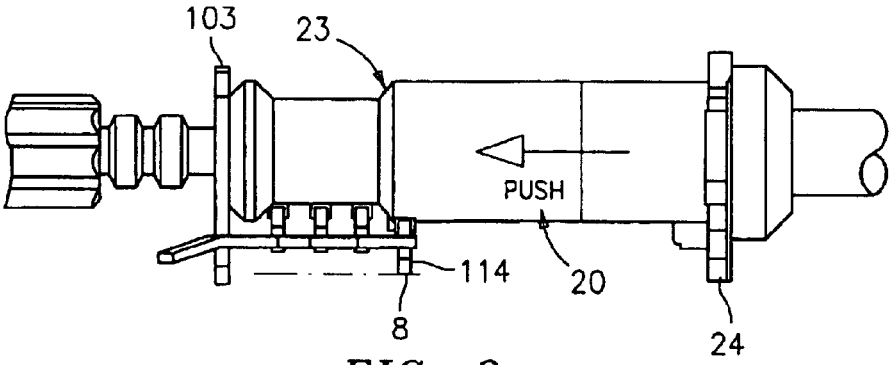
FIG. 9 is a side view of a portion of the mode selecting assembly of FIGS. 3 and 4, and illustrating the setting stem in a first pushed position.

Here too, each of the third and the fourth fingers 113, 114 are sufficiently deflectable so as to deflect from a respective first position where it is not in contact with its associated contact pad 7, 8 on circuit board 4 to a second position where it is in contact with its associated pad on circuit board 4 (compare FIGS. 8 and 9).

To best take advantage of these additional extending fingers 113, 114, the rotatable setting stem 20 is further positionable in at least a third axial position SS2 and a fourth axial position, herein designated SS(−1), this latter position shown most clearly in FIG. 9. In the third axial position, the annular ring contacts and deflects the third finger from its first position (see FIG. 7) to its second position (see FIG. 8). In this second pulled out position SS2, the integrated circuit operates in this second reset/calibration mode, as set forth above.

While the setting stem could have yet another still further pulled out position, the preferred embodiment takes advantage of the setting stem construction wherein the fourth axial position SS(−1) is achieved by pressing setting stem inwardly towards the casing (FIG. 9). In this way, flange 23 of setting stem 20 contacts and deflects the fourth finger from its first position to its second position. Here again, the figures illustrate that when the third finger is in its respective second position the first, second and fourth fingers are in their respective first positions, and when the fourth finger is in its respective second position the first, second and third fingers are in their respective first positions.

When taken in conjunction with the foregoing, it can be seen that when fourth finger is in the second position the integrated circuit is operable in a fourth mode, such as a backlighting mode. Although not material to the present invention, the figures illustrate a restoring spring 24 for biasing stem 20 back towards its SS0 position from its SS(−1) position.

Similarly, sprockets 25, 26 may be used to directly and/or indirectly engage gears for time and date setting, all of which is known in the art.

The present invention is also applicable for use in combination with the invention disclosed and claimed in U.S. Pat. No. 6,203,190. Specifically, the presently disclosed mode selecting assembly 100 would replace the rotating lever 32 and associated parts. In this way, a digital watch such as that disclosed in the '190 patent could take advantage of the mode selecting assembly disclosed herein and it's associated advantages.

Figure 10:
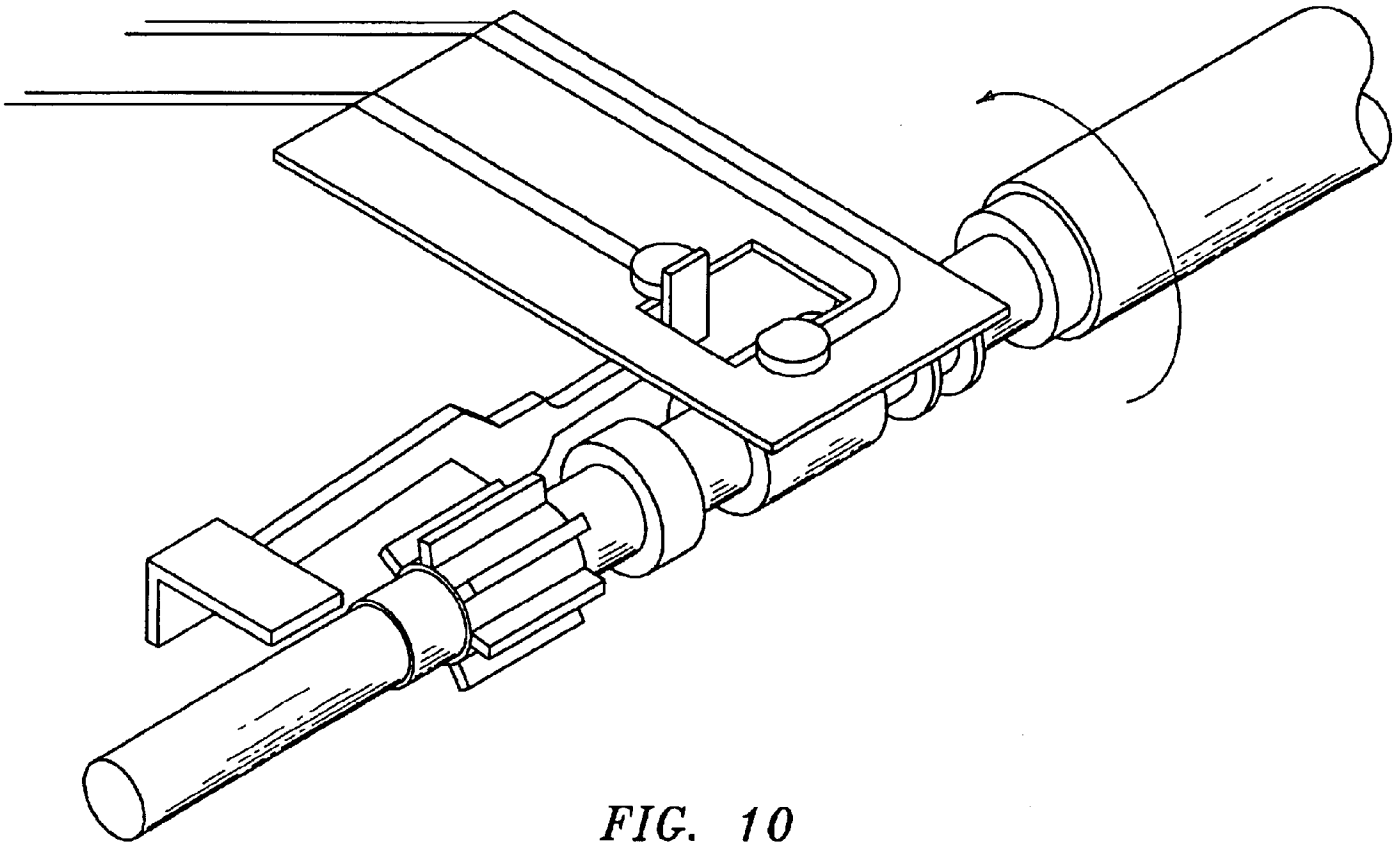
FIG. 10 is an illustration of a portion of an electrical signaling arrangement described in U.S. Pat. No. 6,203,190 and incorporated into an alternate embodiment of the present intention.

Specifically, and with reference also being made to FIG. 10, such a mode selecting assembly would be used in a multimode electronic device, such as a timepiece, of the type having a casing, an electrical signaling arrangement in the casing comprising the arrangement illustrated in FIG. 10 and set forth in greater detail in the '190 patent, for creating intermittent electrical signals, an integrated circuit that is responsive to each intermittent electrical signal for at least changing information displayed on a display based thereon, and a circuit board in the casing, the circuit board having at least a first and a second pad thereon and respective signaling paths from each of the at least first and second pads to the integrated circuit. In all other respects, the mode selecting assembly could comprise features set forth in the first embodiment, namely a flexible hand, coupled to the frame and in the casing, the flexible hand having extending therefrom at least a first finger being sufficiently deflectable so as to deflect from a first position where the first finger is not in contact with its associated pad on the circuit board to a second position where the first finger is in contact with its associated pad on the circuit board; and at least a second finger being sufficiently deflectable so as to deflect from a first position sphere the second finger is not in contact with its associated paid on the circuit board to a second position where the second finger is in contact with its associated pad on the circuit board; a setting stem mounted in and extending out of an opening in the casing, the setting stem being positionable in at least two axial positions, and comprising the annular ring and features set forth above.

Figure 5:
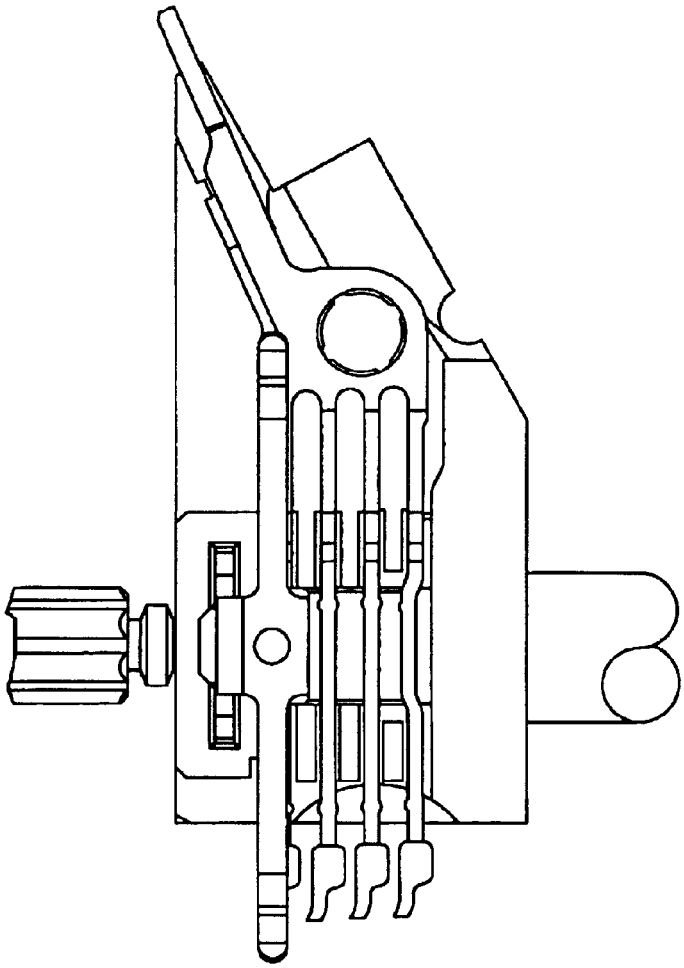
FIG. 5 is a top plan view of FIG. 3.

Reference is now made to FIGS. 3–5 for a disclosure of yet another feature of the present invention, namely the use of setting spring 103 that advantageously, needs no permanent affixing to frame 3 or casing 2. That is it has been recognized that a self-coupling assembly can be achieved by a setting spring 103 in the following manner. Moreover, this spring 103 provides for the discrete positioning of stem 20, as best shown in FIGS. 6–9.

Figure 6:
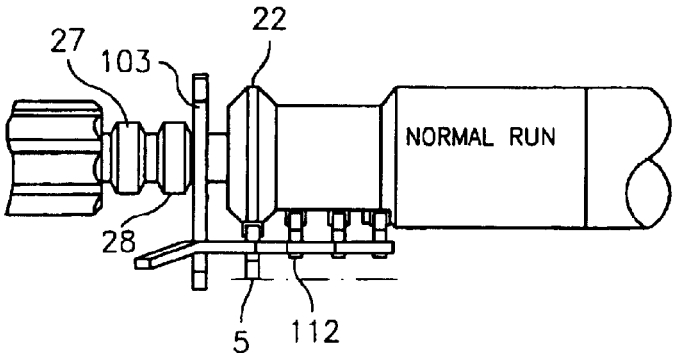
FIG. 6 is a side view of a portion of the mode selecting assembly of FIGS. 3 and 4, and illustrating the setting stem in a normal run position.
Figure 7:
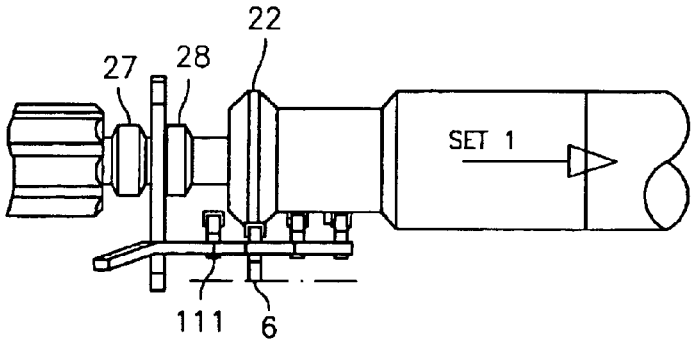
FIG. 7 is a side view of a portion of the mode selecting assembly of FIGS. 3 and 4, and illustrating the setting stem in a first pulled position.

That is, spring 103 includes an aperture 103*a* through which selling stem 20 passes when spring 103 is disposed in slot 104 (see FIGS. 4, 6, and 9). In this way, when the exploded assembly illustrated in FIG. 3 is constructed, spring 103 primarily functions to provide for the discrete positioning of stem 20. For example, FIGS. 6–9 illustrate the plurality of positions of stem 20. With each push and/or pull of stem 20, the position of annular rings 27 and 28 with respect to spring 103 can vary, i.e. in a first position (FIG. 6), both annular rings 27 and 28 are seen to be to the left of spring 103, while in a second position (FIG. 7). spring 103 is between annular rings 27 and 28, while in yet a third position (FIG. 8), both annular rings 27 and 28 are seen to be to the right of spring 103, and yet in a fourth position (FIG. 10), both annular rings 27 and 28 are to be to the left of spring 103 and in tact flange 23 can be seen to be up against spring 103. The interaction of rings 27 and 28 with spring 103 ensures that the stem does not inadvertently move from its discrete positioning. A welded head 106 can also be used to provide for secure coupling of the assembly.

In this way, a self-coupling assembly for a timepiece that comprises a circuit board in the casing, a flexible hand, coupled to the frame and in the casing, an axial displaceable setting stem mounted in and extending within an elongated bore in the frame, the setting stem being positionable in at least two axial positions for selectively contacting and deflecting fingers of the flexible hand from respective first positions to second positions and in contact with a circuit board; and a setting spring, the setting spring being positioned in a slot in the frame, the setting spring having an aperture through which the setting stem passes when the setting spring is positioned in the slot, the setting spring further including outwardly extending wings for providing the desired pressure on its support, in this case, the circuit board.

While the invention has been particularly shown and described with respect to preferred embodiments thereof, it will be understood by those skilled in the art that changes in form and details may be made therein without departing from the scope and spirit of the invention.

For example, the present invention has been disclosed above with particular reference to timepieces. However, one skilled in the art shall now appreciate that the present invention is equally applicable, and as claimed herein, to devices other than timepieces, such as, but not limited to, clocks, thermometers, such as wall mounted thermometers and security devices, such as wall mounted or handheld devices for the home or office. Therefore, reference to a timepiece should equally be understood to refer to at least any of the aforementioned other devices. That is, present invention methodology is applicable in any electronic device in which a mode selecting assembly, such as those disclosed herein, permits selective mode selection and setting as set forth above. Also, while FIGS. 2 and 3 have assumed that appropriate VDD levels provide the appropriate signaling, appropriately configured grounding voltage levels can achieve the same results, and is therefore contemplated herein.

What is claimed is:

1. A mode selecting assembly for a timepiece of the type having a casing, a frame in the casing, an integrated circuit disposed in the casing and operable in at least a first mode and a second mode, a circuit board also disposed in the casing and having (i) at least a first contact pad and a second contact pad and (ii) respective signaling paths from each of the at least first and second contact pads to the integrated circuit, the mode selecting assembly comprising:

a flexible hand, coupled to the frame and in the casing, the flexible hand having extending therefrom:

at least a first finger being sufficiently deflectable so as to deflect from a first position where the first finger is not in contact with its associated pad on the circuit board to a second position where the first finger is in contact with its associated pad on the circuit board; and at least a second finger being sufficiently deflectable so as to deflect from a first position where the second finger is not in contact with its associated pad on the circuit board to a second position where the second finger is in contact with its associated pad on the circuit board;

a setting stem mounted in and extending out of an opening in the casing, the setting stem being positionable in at least a first and a second axial position, the setting stem comprising:

an annular ring for selectively contacting and deflecting the at least first and second fingers front their respective first positions to second positions;

wherein in the at least first axial position, the annular ring contacts and deflects the first finger from its first position to its second position and wherein in the second axial position, the annular ring contacts and deflects the second finger from its first position to its second position;

wherein when the first finger is in the second position the integrated circuit is operable in a first mode, and when the second finger is in the second position the integrated circuit is operable in a second mode;

whereby when the first finger is in the second position the second finger is in the first position, and when the second finger is in the second position the first finger is in the first position.

2. The selecting assembly as claimed in claim 1, wherein the flexible hand comprises at least a third finger and a fourth finger and the circuit board comprises at least a third contact pad and a fourth contact pad and respective signaling paths from each of the at least third and fourth contact pads to the integrated circuit;

wherein each of the third and the fourth fingers are sufficiently deflectable so as to deflect from a respective first position where the respective finger is not in contact with its associated contact pad on the circuit board to a second position where the respective finger is in contact with its associated pad on the circuit board; and wherein the setting stem is further positionable in at least a third and a fourth axial position, wherein in the at least third axial position, the annular ring contacts and deflects the third finger from its first position to its second position and wherein in the fourth axial position, the setting stem contacts and deflects the fourth finger from its first position to its second position;

wherein when the third finger is in the second position the integrated circuit is operable in a third mode, and when the fourth finger is in the second position the integrated circuit is operable in a fourth mode;

whereby when the third finger is in its respective second position the first, second and fourth fingers are in their respective first positions, and when the fourth finger is in its respective second position the first, second and third fingers are in their respective first positions.

3. The selecting assembly as claimed in claim 1, wherein the setting stem is rotatably mounted in the casing.

4. A mode selecting assembly for a multimode electronic device of the type having a casing, an electrical signaling arrangement in the casing for creating intermittent electrical signals, an integrated circuit that is responsive to each intermittent electrical signal for at least changing information displayed on a display based thereon, a circuit board in the casing, the circuit board having at least a first and a second pad thereon and respective signaling paths from each of the at least first and second pads to the integrated circuit, the mode selecting assembly comprising:

a flexible hand, coupled to the frame and in the casing, the flexible hand having extending therefrom:

at least a first finger being sufficiently deflectable so as to deflect from a first position where the first finger is not in contact with its associated pad on the circuit board to a second position where the first finger is in contact with its associated pad on the circuit board; and at least a second finger being sufficiently deflectable so as to deflect from a first position where the second finger is not in contact with its associated pad on the circuit board to a second position where the second finger is in contact with its associated pad on the circuit board;

a setting stem mounted in and extending out of an opening in the casing, the setting stem being positionable in at least a first and a second axial position, the setting stem comprising:

an annular ring for selectively contacting and deflecting the at least first and second fingers from their respective first positions to second positions;

wherein in the at least first axial position, the annular ring contacts and deflects the first finger from its first position to its second position and wherein in the second axial position, the annular ring contacts and deflects the second finger from its first position to its second position;

wherein when the first finger is in the second position the integrated circuit is operable in a first mode, and when the second finger is in the second position the integrated circuit is operable in a second mode;

whereby when the first finger is in the second position the second finger is in the first position, and when the second finger is in the second position the first finger is in the first position.

5. The selecting assembly as claimed in claim 4, wherein the flexible hand comprises at least a third finger and a fourth finger and the circuit board comprises at least a third contact pad and a fourth contact pad and respective signaling paths from each of the at least third and fourth contact pads to the integrated circuit;

wherein each of the third and the fourth fingers are sufficiently deflectable so as to deflect from a respective first position where the respective finger is not in contact with its associated contact pad on the circuit board to a second position where the respective finger is in contact with its associated pad on the circuit board; and wherein the setting stem is further positionable in at least a third and a fourth axial position, wherein in the at least third axial position, the annular ring contacts and deflects the third finger from its first position to its second position and wherein in the fourth axial position, the setting stem contacts and deflects the fourth finger from its first position to its second position;

wherein when the third finger is in the second position the integrated circuit is operable in a third mode, and when the fourth finger is in the second position the integrated circuit is operable in a fourth mode;

whereby when the third finger is in its respective second position the first, second and fourth fingers are in their respective first positions, and when the fourth finger is in its respective second position the first, second and third fingers are in their respective first positions.

6. The selecting assembly as claimed in claim 4, wherein the setting stem is rotatably mounted in the casing, and wherein the setting stem has at least one tooth for engaging the electrical signaling arrangement.

* * * * *